US005943935A

United States Patent [19]

Brayton et al.

[11] Patent Number: 5,943,935

[45] Date of Patent: Aug. 31, 1999

[54] LIGHTWEIGHT DIMENSIONALLY STABLE STEEL RULE DIE

[75] Inventors: Russell S. Brayton, Elkhart, Ind.; Michael Kush, Midlothian; Robert McArtan, Powhatan, both of Va.

[73] Assignee: Atlas Die, Inc., Elkhart, Ind.

[21] Appl. No.: 08/808,463

[22] Filed: Mar. 3, 1997

[51] Int. Cl.[6] ..... B26D 7/00

[52] U.S. Cl. ..... 83/685; 76/107.8; 493/61; 493/354

[58] Field of Search ..... 76/107.8; 83/656, 83/679, 685, 686, 695, 698.11, 698.31, 698.71, 698.91, 699.11, 678; 493/59, 61, 73, 354, 363, 372, 473

[56] References Cited

U.S. PATENT DOCUMENTS

| | | | |
|---|---|---|---|
| 3,108,327 | 10/1963 | Phillips et al. | 76/107.8 |
| 3,109,328 | 11/1963 | Giese | 76/107.8 |
| 3,196,716 | 7/1965 | Bonwit et al. | 76/107.8 |
| 3,345,857 | 10/1967 | Harman | 76/107.8 |
| 3,666,593 | 5/1972 | Lee | 156/285 |
| 3,699,202 | 10/1972 | Verbestel | 264/109 |
| 3,863,550 | 2/1975 | Sarka et al. | 493/468 |
| 4,052,886 | 10/1977 | Buick | 483/468 |
| 4,162,877 | 7/1979 | Nyberg | 425/84 |
| 4,249,432 | 2/1981 | Graboyes et al. | 76/107.8 |
| 4,326,434 | 4/1982 | Mohr et al. | 76/107.8 |
| 4,344,798 | 8/1982 | Gaul et al. | 106/164.3 |
| 4,359,507 | 11/1982 | Gaul et al. | 428/425.1 |
| 4,361,662 | 11/1982 | Gaul et al. | 524/14 |
| 4,373,929 | 2/1983 | Smith | 493/355 |
| 4,414,361 | 11/1983 | Gaul et al. | 524/702 |
| 4,486,557 | 12/1984 | Gaul et al. | 523/446 |
| 4,568,323 | 2/1986 | Roeder | 492/473 |
| 4,981,061 | 1/1991 | Hillock et al. | 83/697 |
| 5,008,359 | 4/1991 | Hunter | 527/103 |
| 5,029,505 | 7/1991 | Holliday | 83/652 |
| 5,140,872 | 8/1992 | Holliday et al. | 76/107.8 |
| 5,143,768 | 9/1992 | Wilderman et al. | 428/68 |
| 5,146,832 | 9/1992 | Wilson et al. | 83/698 |
| 5,197,367 | 3/1993 | Holliday | 83/698 |
| 5,211,084 | 5/1993 | Holliday et al. | 76/107.8 |
| 5,275,076 | 1/1994 | Greenwalt | 83/698 |
| 5,333,519 | 8/1994 | Holliday et al. | 76/107.8 |

*Primary Examiner*—Clark F. Dexter
*Attorney, Agent, or Firm*—Woodward, Emhardt, Naughton, Moriarty & McNett

[57] ABSTRACT

A lightweight, dimensionally stable steel rule die for cutting and scoring carton blanks having a die board containing the cutting and scoring rules which is formed of a laminated plastic construction adapted to register and coact with a steel counterplate over prolonged production runs and maintain registration within a tolerance range of about ±0.002 inches.

11 Claims, 4 Drawing Sheets

LIGHTWEIGHT DIMENSIONALLY STABLE STEEL RULE DIE

BACKGROUND OF THE INVENTION

1. Field of the Invention

The present invention is directed generally to steel rule dies for punching out sheet material such as folding carton blanks and, more particularly, to such dies of the type incorporating lightweight rigid plastic dieboard constructions.

2. Description of the Prior Art

Steel rule dies have been used for many years for cutting, creasing and perforating cardboard, paperboard and other sheet materials in making folded carton blanks. The steel rules are arranged in a predetermined pattern to form the desired creasing and cutting patterns in the carton blank. The steel rules are retained either between blocks held in a steel frame or chase by wedges or quoins (block dies) or within slots formed in a rigid die board (jig dies) which, as with the block dies, may be held in a chase with quoins. The male die retaining the steel rules cooperates with the female die, also called the counterplate, to make the impressions in the carton blank.

Depending on the type of construction, the dies have varying useful lives, the more durable of which may be required to make hundreds of thousands, or even millions, of impressions. It is very important to maintain the dimensional stability of the dies over long periods of time and throughout each production run. Moreover, the cutting and creasing edges of the rules wear out, loosen or otherwise become defective over time, and it is desirable to replace them by reknifing the dies rather than by having to replace the entire die. Then too, it is important to be able to efficiently reknife the dies with a minimum of cost.

The base material for the steel rule dies have been fabricated from a variety of materials including wood, laminated wood, metal, and plastic materials. Each offers various advantages and disadvantages, such as expense, weight, dimensional stability, wearability, etc. For example, a die base made of steel offers very high dimensional stability and durability but is relatively much more expensive to produce. Consequently, steel is the construction of choice for dies, especially counterplates, intended to be used over long periods of time and prolonged production runs. However, depending on its overall dimensions the die, and particularly the male die base containing the rules, may weigh up to several hundred pounds. Because of the excessive weight, such dies cannot be manually lifted and handled by one or even two men. As a result, labor costs to change dies becomes a significant and sometimes even prohibitive factor.

Because the steel counterplate is much thinner than the die board which receives the rules, the use of steel in the counterplate does not add significantly to overall weight. Since the use of one piece steel counterplates became common in the folding carton industry in approximately the 1970s, manufacturers of steel rule dies and die base materials have been searching for ways to maintain the relationship of die base to counterplate registration. It is vital that the two stay in close registration over large areas, for when one expands or shrinks at a different rate than the other, undesirable product is produced.

The need for dimensionally stable, low cost, lightweight die boards to accept the cutting and creasing rules is also due to the advances in the technology for cutting the rule slots.

Die boards made of wood materials for example, while cheaper and lighter than steel, are also much less dimensionally stable due to their susceptibility to expansion, shrinkage and warpage. Traditionally, slots in wooden die boards have been made using a jig saw, and accuracy of placement of the slot locations depended heavily upon the skill of the human operator. In more recent times the use of lasers to create the slots for the rules has significantly increased this accuracy. To compare, a die board having slots made using a jig saw will typically allow dimensional accuracy of + or −0.015 inches over the entire die, whereas the slots in a laser cut die board are typically dimensionally accurate to + or −0.002 inches. Nevertheless, the tighter tolerances achieved by laser cutting techniques are lost over time in wooden die boards because of their susceptiblity to expansion, shrinkage and warpage.

With the increased dimensional accuracy offered by laser cutting techniques, attempts have been made to find suitable low cost, lightweight materials that offer greater inherent dimensional stability than wood materials such as maple, birch or plywoods.

Many different attempts have been made to stabilize cellulose fiber type products and other laser processable type materials for the end purpose of registering and maintaining the registration long term to the counterplate. Included among these was the use of sealant "dunk tanks" and the incorporation of resins in the die base material manufacturing process. One such material, known in the art as "Permaplex", is used to make a type of die called a "layered die." Layered dies includes a Permaplex inner core surrounded on the perimeter by steel rails and also by steel sheets on the top and bottom to fully encapsulate the core. The layered dies are characterized as being very heavy, more stable, and machine and labor intensive on assembly.

Another such effort which has found use is the bonded die, U.S. Pat. No. 3,863,550. This die includes two outer plates with an epoxy material in between that is poured in after the steel rules are installed in place. This die has high dimensional stability but is characterized by longer delivery times, being very heavy in weight, labor intensive and expensive to produce, and still having delamination tendencies.

U.S. Pat. No. 5,143,768 to Wilderman et al. teaches the use of a laminated die board structure comprising a rigid core of a plastic material, such as polyurethane, having a polyurea-cellulose composite secured thereto. While this structure offers the possibility of greater dimensional stability due to its greater ability to withstand the effects of temperature and humidity, dimensional stability is still compromised during the knifing process and also when the die board is positioned in the die chase. When for example slots (kerfs) are cut into the polyurethane material either by laser or jig saw, the width of the; slots is sized slightly less than the width of the rule to allow for a friction fit. As the rule is inserted into the slot, the pressure exerted against the sides of the slot by the rule expands the slot thereby changing the relative spacing and positioning of the rules. Also, when the die board is positioned in the die chase and pressure is applied by the quoins to hold the die board into place, too much pressure can be applied thereby causing undesired movement in the positioning of the rules.

SUMMARY OF THE INVENTION

According to one preferred variation, the present invention may be characterized by a flat board die assembly for cutting and scoring carton blanks formed of paperboard and the like, comprising a die board having opposed major surfaces and a plurality of marginal side surfaces, the die board having a plurality of slots receiving rules therein, the slots and the rules having thicknesses sized to permit a friction fit of the rules inside the slots, the die board having a lightweight construction no greater than about three pounds per square foot, the die board further having a laminated structure including a core which is of a rigid polyurethane material, the core having opposed major surfaces, the die board further having a cover sheet secured to one of the opposed major surfaces, the cover sheet formed of a different material than the core, a steel counterplate coacting with the rules in the die board to produce cutting and scoring impressions in the carton blanks, and a die chase surrounding the marginal edges of the die board and establishing positional registration between the die board containing the rules and the counterplate.

In another preferred variation, the present invention is characterized by a flat board die assembly for cutting and scoring carton blanks formed of paperboard and the like, comprising a die board having opposed major surfaces and a plurality of marginal side surfaces, the die board having a plurality of slots receiving rules therein, the slots and the rules having thicknesses sized to permit a friction fit therebetween, the die board having a lightweight construction no greater than about three pounds per square foot, and a die chase surrounding the marginal edges of the die board, and means operatively connected to the die board and the die chase for maintaining positional accuracy between the rules within a range of about ±0.002 inches.

It is an object of the present invention to provide an improved steel rule die for cutting and scoring carton blanks.

It is a further object of the present invention to provide an improved steel rule die which includes a lightweight die board which has a dimensionally stable construction which is capable of maintaining close registration with a steel counterplate over prolonged periods and high production quantities.

Related objects and advantages of the present invention will become even more apparent by reference to the following drawings and detailed description.

DESCRIPTION OF THE PREFERRED EMBODIMENT

Figure 1:
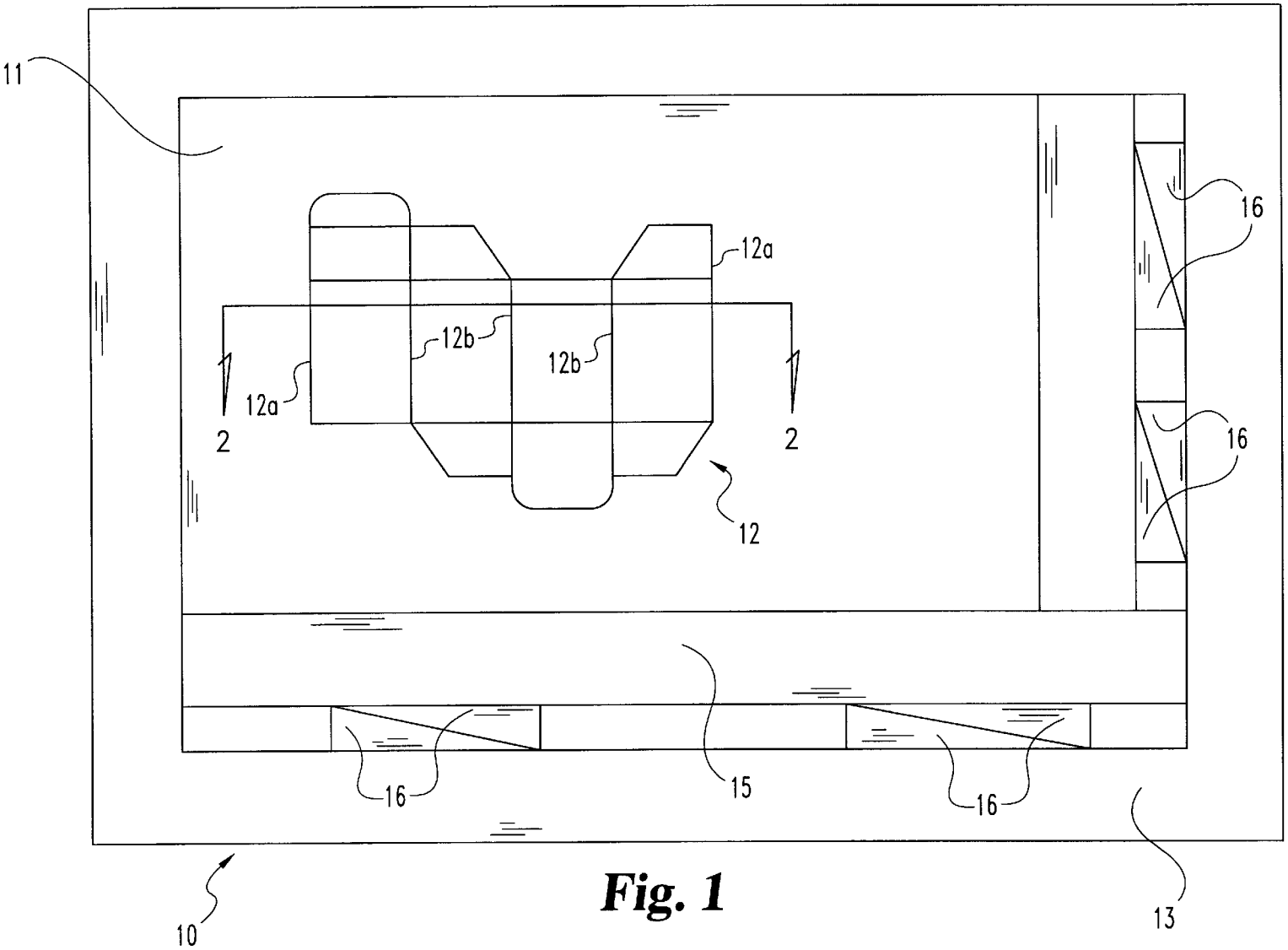
FIG. 1 is a top plan view showing the steel rule die board with filler furniture mounted within the chase and held in place by quoins.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Figure 3:
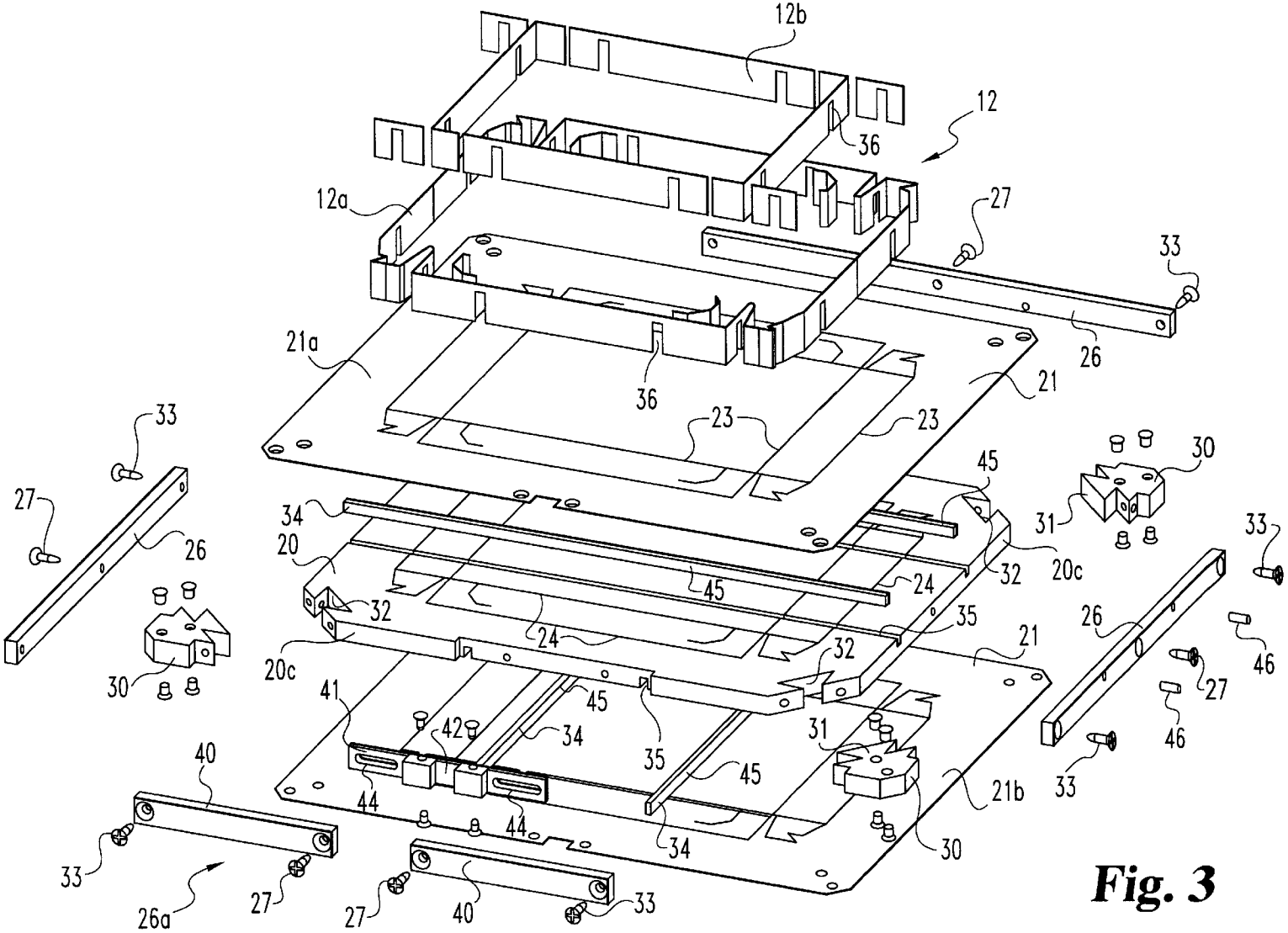
FIG. 3 is an exploded view of the steel rule die board invention shown in FIG. 1.
Figure 4:
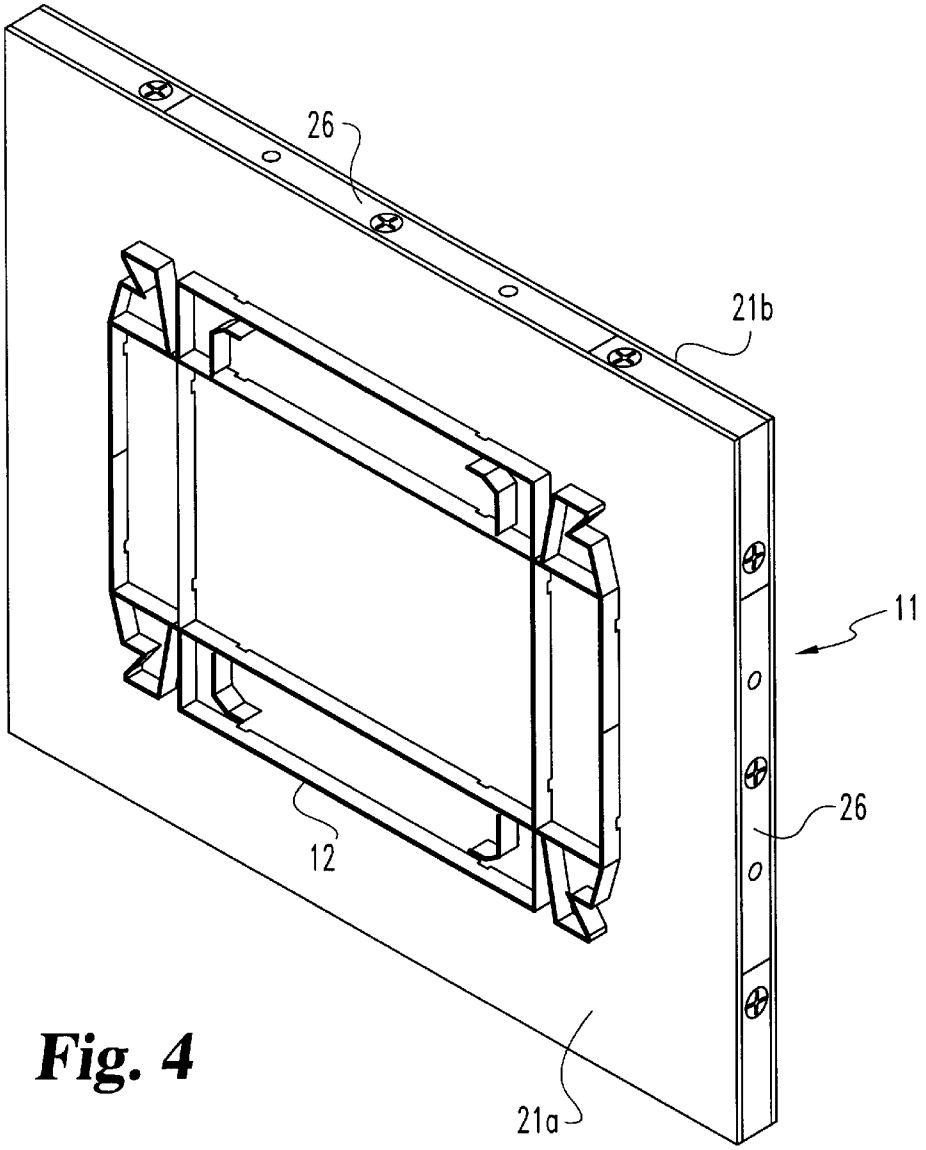
FIG. 4 is a perspective view of the assembled die board.

With reference to FIG. 1, there is shown a male die portion 10 of a steel rule die comprising a die board 11 from which extends a plurality of rules 12 typically including cutting and creasing rules 12*a* and 12*b*, respectively. The precise arrangement of the cutting and creasing rules shown is exemplary only, it being understood such will vary in accordance with the various shapes and types of carton blanks to be formed. Thus, FIGS. 3 and 4 depict a different exemplary rule pattern than that shown in FIGS. 1 and 2. The die board 11 is received inside a frame 13, also called a die chase. various sized die boards 11 can be fitted within the chase 13. In order to secure the die board 11 in the chase 13, it is located in the desired position within the chase and the gap between the outside edge of the die board and the inside edge of the chase is filled with filler furniture 15 comprised of usually wood strips. Pressure applying devices which in FIG. 1 take the form of wedge shaped quoins 16 bridge the remaining gap between the furniture 15 and chase 13. The number of types of quoins 16 employed may be varied as desired, it being understood that many types of quoins are conventional. Thus, wedge type quoins 16 shown in FIG. 1 are exemplary only. The positions of quoins 16 are adjusted in order to vary the pressure they exert against the die board 11 to lock its position within the die chase 13.

Figure 2:
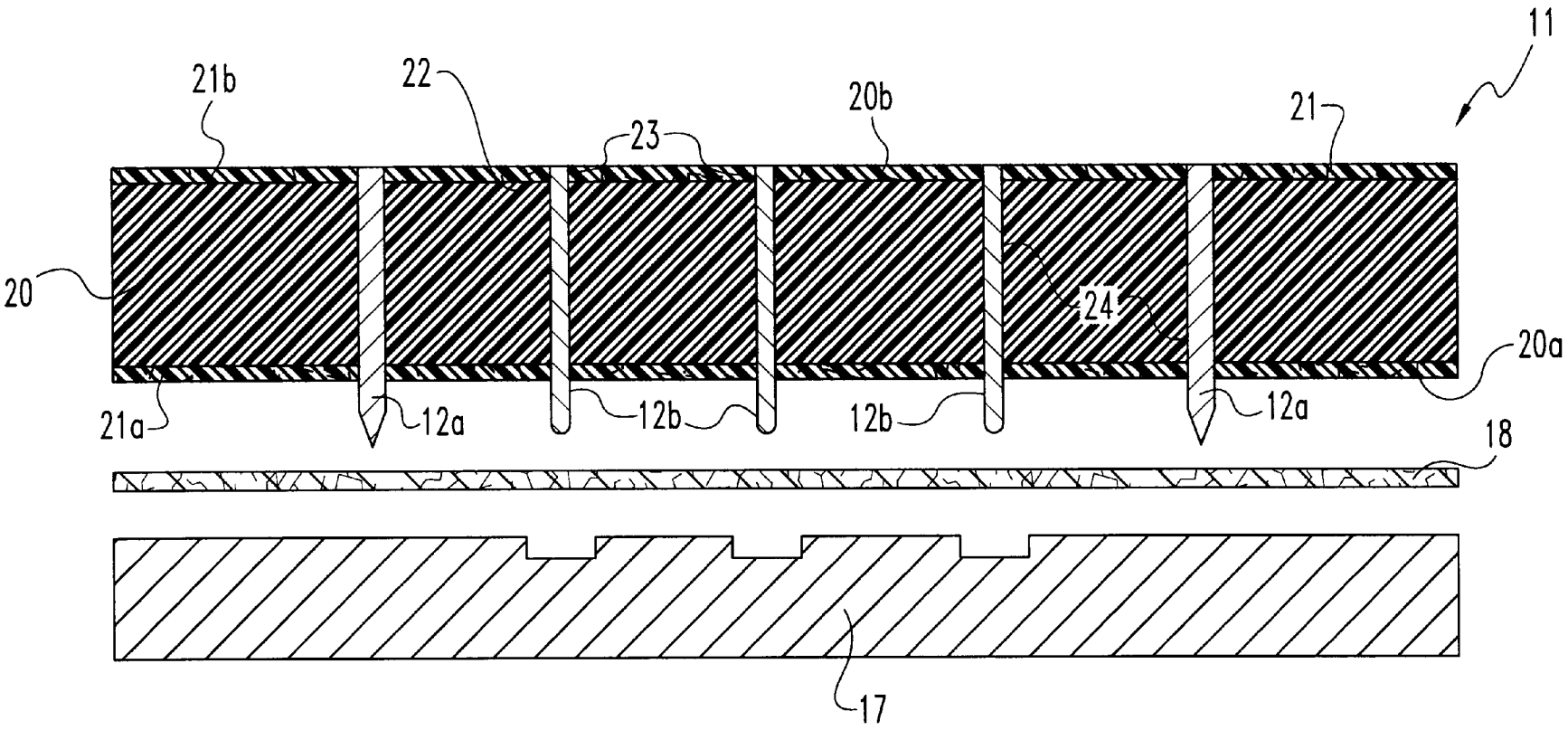
FIG. 2 is a section view taken along lines 2—2 in FIG. 1.

Referring to FIG. 2, the die board 11 is shown with cutting rules 12*a* and creasing rules 12*b* received within and extending downwardly from the die board 11 in position to coact with the steel counterplate 17 to make the necessary cutting, scoring and creasing impressions in a carton blank 18. In order to minimize weight, the die board 11 is provided with a laminate structure including an inner core 20 and bottom and top cover sheets 21*a* and 21*b*, respectively.

The inner core 20 is made of a lightweight, low-density material which exhibits sufficient resiliency to permit multiple reknifings without causing the rules to exhibit looseness during the course of production runs. Preferably, the inner core 20 is comprised of a structural foam or other resilient non-cellulose lightweight material. One suitable class of materials is rigid polyurethane foam having a density of at most about 30 to 40 pounds per cubic foot. One such material is sold under the product name LAST-A-FOAM FR-6700 and is manufactured by General Plastics Manufacturing Company of Tacoma, Wash.

Cover sheets 21 serve to protect the relatively brittle inner core 20 and provide a greater degree of strength to the overall structure. The cover sheets 21 may be comprised of plastic, composite or metallic type materials. Preferably, the material selection is based on the criteria of high strength, low moisture adsorption, superior temperature stability, and low weight. One especially preferred cover sheet material is a fiberglass reinforced phenolic resin known by the NEMA (National Electrical Manufacturers Association) designation "G-10." The G-10 sheet material is available from several manufacturers, including for example Current, Inc. located in East Haven, Conn.

The cover sheets 21*a*, 21*b* each form a respective major surface of the die board 11 and are secured to the opposed bottom and top major surfaces 20*a* and 20*b*, respectively, of inner core 20 by a suitable adhesive 22 characterized by relatively high peel strength in relation to sheer strength. This allows the inner core 20, which inherently possesses some degree of dimensional instability, to exhibit a certain amount of expansion, contraction or other movement without transferring this energy to the cover sheets thus preventing expansion or contraction of the entire die. At the same time, the adhesive prevents the cover sheets from being pulled away or otherwise being delaminated from the core. One particularly preferred adhesive product is a double side adhesive tape characterized by a thin polyester film coated on both sides with a heavy coating of an aggressive, high performance, rubber base adhesive and having a removable backing. One form of this product is sold under the product designation MACBOND IB-1184 and is sold by MACtac, USA located in Stow, Ohio. The peel strength of this product is approx. 15 lbs./in. under test method PSTC-3 (stainless steel—30 min.) and the shear strength (measured by hours to fail) is over 300 hours under test method PSTC-7 (stainless steel—1000 g./sq.in. @ 72° F.). Acrylic structural adhesive products, such as for example LOCTITE 392, may alternatively also be used.

The preferred general mechanical characteristics of the composite dieboard formed by the cover sheets 21 and inner core 20 are as follows. A thermal expansion coefficient of less than $13\times10^{-6}$ inch/degree Fahrenheit; bowing of material of less than 1/16 inch over the entire die board (maximum size 48 inches by 72 inches); and overall weight of less than about 3 pounds per square foot for conventional thicknesses; less than 0.5% gain in weight by adsorption in 90% plus relative humidity; and less than 0.0005 inch/inch growth when submersed in water for 24 hours.

In order to receive the rules 12, a pattern of corresponding slots or kerfs are formed in the cover sheets 21 and inner core 20. Although the pattern of the slots for the cover sheets and inner core are identical the widths of the slots (also called kerfs) differ, as do the relative spacing between the slots. For example, the width of the kerfs 23 in the cover sheets 21 are sized slightly larger than the width of the rules 12 so as to permit the rules to be received therethrough in a close free sliding fit. In contrast, the width of the kerfs 24 in the inner core 20 are sized somewhat smaller than the width of the rules 12 so as to allow the rules to be held in an interference or close friction fit within the kerfs 24. Preferably, the kerfs in both the cover sheets 21 and inner core 20 are generated by laser cutting, water jet or other similarly accurate techniques which acheive positional accuracy of at least about 0.002 inches. However, since the corresponding widths of the kerfs for the inner core 20 and cover sheets 21 differ, they are separately formed before the inner core and cover sheets are bonded together. Since the inner core material is relatively more compressible than the steel rules 12, the inner core will expand slightly when the rules 12 are inserted. Accordingly, in order to ensure proper registration of the rules with the counterplate, it has been found that it is important to employ a compensation formula in locating the kerf positions to account for this expansion of the inner core when the rules are later installed. In testing it has been found that for every kerf of 0.028" expansion when cutting and creasing rule is inserted occurs in the kerf at the rate of 0.00035" per kerf regardless of length.

Thus, inner core expansion is accounted for by applying a compensation factor X determined according to the following formula: $X=1-N(K_e)/L$ wherein N equals the number of rules in a selected axial direction, $K_e$ equals the amount of kerf expansion per slot which occurs when the rules are inserted in the inner core slots, and L equals the total length of the inner core along the selected axial direction. As an example, if the inner core 20 has a length of 36 inches and there are a total of 40 slots or kerfs having widths of 0.028" each, the compensation factor which is needed to account for inner core expansion is 0.9996 per lineal inch.

FIG. 3 shows an unassembled exploded view of the die board 11, whereas FIG. 4 shows the assembled die board 11. The marginal sides 20*c* of the inner core 20 are protected by aluminum or similar lightweight material side rails 26. Screw fasteners 27 secure the rails 26 directly to inner core 20. In addition protective corner blocks 30 are attached at the corners of inner core 20. Corner blocks 30 each have a dovetail 31 which interlocks with inner core 20 inside a corresponding shaped groove 32. Screw fasteners 33 secure the respective ends of side rails 26 to corner blocks 30 and to inner core 20. The corner blocks 30 are preferably made of Permaplex, aluminum or other suitable high strength, lightweight materials.

One of the side rails, identified as 26*a*, is formed by an assembly of two identically formed rail portions 40 and a slotted middle rail portion 41. Rail portion 41 includes a centerline notch 42 which allows accurate alignment of the die assembly in the die machine (not shown). The position of centerline notch 42 along inner core 20 is adjustable by adjusting the position of fasteners 27 along slots 44.

In order to prevent the rules 12 from losing their positional relationship due to expansion, contraction, warpage or other movement due to any dimensional instability of the inner core 20, a maintaining means 45 is provided which maintains the positional relationship of the rules 12 to within the 0.002 inches tolerance achieved by laser cutting techniques employed to establish the kerf locations. Maintaining means 45 includes a lattice of rigid inner rails 34, preferably formed of steel, which extend between side rails 26 and are housed in grooves 35 formed in the opposed major surfaces of inner core 20. Another set of grooves 36 are formed in the rules 12 to receive the inner rails 34. In FIG. 3, a total of four inner rails 34 are provided and form a rectangular shaped lattice interlocking the positions of the rules 12 against any movement of the inner core 20. Inner rails 34 are secured to side rails 26 by set screws 46 extending through side rails 26. The total number of rails 34 may be varied to achieve the desired degree of positional stability. Other forms of adjustable connecting devices may alternatively also be employed in the place of set screws 46.

In order to provide the ability to tighten or loosen the securement of the inner rails 34 to side rails 26 after the die board assembly is locked into the chase 13, and is of the required dimensions, set screws 46 are adjusted. For this purpose, it is advantageous to size the length of the inner rails 34 so that they are slightly shorter, perhaps 0.001"–0.002", than the corresponding expanded dimensions of the inner core 20 when the cutting and creasing rules are installed. This allows a final adjustment to be made by tightening the set screws 46 thereby urging the side rails 26 closer together and contracting the inner core 20 until side rails 26 contact the ends of inner rails 34.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A flat board die assembly for cutting and scoring carton blanks, comprising:

a die board having opposed major surfaces and a plurality of marginal side surfaces, said die board having a plurality of slots formed therein, said die board further having a non-cellulose construction which is substantially resistant to warpage, shrinkage and expansion due to humidity and temperature and yet is deformable under pressure caused by insertion of said rules into said slots;

a plurality of rules frictionally fit within said slots;

a steel counterplate coacting with said rules in said die board to produce cutting and scoring impressions in the carton blanks;

a plurality of perimeter rails secured to the marginal side surfaces of said die board;

a die chase surrounding said perimeter rails and said die board;

at least one inner rail through at least a portion of said die board and spanning between opposed marginal side surfaces of said die boards; and an adjustable connector connecting said inner rail and opposed ones of said perimeter rails, wherein said adjustable connector compensates for dimensional differences between said rules with respect to said counterplate.

2. The flat board die assembly of claim 1 wherein said non-cellulose construction of said die board comprises a laminated structure including an inner core which is of a rigid polyurethane material, said inner core having opposed major surfaces, said laminated structure further including at least one cover sheet secured to a respective one of said opposed major surfaces, said cover sheet formed of a non-cellulose material which is different from said inner core.

3. The flat board die assembly of claim 2 wherein said non-cellulose material of said cover sheet is comprised of a cured fiber reinforced epoxy resin, said cover sheet being secured to said inner core with an adhesive.

4. The flat board die assembly of claim 3 wherein said cover sheet comprises a top cover sheet and bottom cover sheet secured to said opposed major surfaces of said inner core.

5. The flat board die assembly of claim 2 wherein said non-cellulose material of said cover sheet is a more rigid material than said core, said cover sheet having a plurality of slots receiving therethrough said rules in a loose sliding fit.

6. The flat board die assembly of claim 5 wherein said non-cellulose material of said cover sheet is comprised of a cured fiber reinforced epoxy resin, said cover sheet being secured to said inner core with an adhesive.

7. The flat board die assembly of claim 1 further comprising a plurality of corner blocks secured to said die board and connecting adjacent ones of said perimeter rails.

8. The flat board die assembly of claim 1 wherein said at least one inner rail comprises a first and a second inner rail, said inner rails extending in a direction which is substantially perpendicular to each other.

9. The flat board die assembly of claim 8 wherein said at least one inner rail further comprises a third inner rail, said inner rails forming a lattice.

10. The flat board die assembly of claim 1 wherein said non-cellulose construction comprises a non-wooden construction.

11. The flat board die assembly of claim 1 wherein said adjustable connector is a set screw.

* * * * *

UNITED STATES PATENT AND TRADEMARK OFFICE

CERTIFICATE OF CORRECTION

PATENT NO : 5,943,935

DATED : August 31, 1999

INVENTOR(S) : Russell S. Brayton et al.

It is certified that error appears in the above-identified patent and that said Letters Patent is hereby corrected as shown below:

In Section [56] of the title page, col. 2, line 9, please delete "492/473" and insert in lieu thereof --493/473--.

In col. 2 of the title page, after "Attorney, Agent or Firm", please delete "Woodward" and insert in lieu thereof --Woodard--.

In col. 2, line 54, please delete the semi-colon (";") after "the".

In col. 4, line 9, please delete "various" and insert in lieu thereof --Various--.

In col. 7, line 11, please delete "boards" and insert in lieu thereof --board--.

Signed and Sealed this

Twentieth Day of June, 2000

*Attest:*

Q. TODD DICKINSON

*Attesting Officer*

*Director of Patents and Trademarks*